US007605687B2

(12) United States Patent
Morris

(10) Patent No.: US 7,605,687 B2
(45) Date of Patent: Oct. 20, 2009

(54) AMBIENT CONDITION DETECTOR WITH VARIABLE PITCH ALARM

(76) Inventor: Gary Jay Morris, 2026 Glenmark Ave., Morgantown, WV (US) 26505-2900

( * ) Notice: Subject to any disclaimer, the term of this patent is extended or adjusted under 35 U.S.C. 154(b) by 252 days.

(21) Appl. No.: 11/595,031

(22) Filed: Nov. 9, 2006

(65) Prior Publication Data

US 2008/0111706 A1 May 15, 2008

(51) Int. Cl.
*G08B 3/10* (2006.01)

(52) U.S. Cl. ..... 340/384.73; 340/692; 340/577; 340/632; 340/628; 340/629; 340/521; 340/533

(58) Field of Classification Search ..... 340/692, 340/577, 632, 628, 521, 533, 384.73, 629
See application file for complete search history.

(56) References Cited

U.S. PATENT DOCUMENTS 4,600,914 A 7/1986 Walsh
4,602,246 A 7/1986 Jensen
4,688,021 A 8/1987 Buck et al.
4,926,159 A 5/1990 Bartlett
4,935,952 A 6/1990 Dutra
5,349,338 A 9/1994 Routman
5,576,685 A * 11/1996 Saito ..... 340/384.1
5,663,714 A 9/1997 Fray
5,808,541 A 9/1998 Golden
5,990,797 A 11/1999 Zlotchenko
6,078,269 A 6/2000 Markwell
6,114,967 A * 9/2000 Yousif ..... 340/690
6,133,839 A 10/2000 Ellul et al.
6,232,882 B1 5/2001 Hed et al.
6,323,780 B1 11/2001 Morris
6,426,703 B1 7/2002 Johnston et al.
6,522,248 B1 * 2/2003 Andres et al. ..... 340/521
6,553,100 B1 4/2003 Chen et al.
6,658,123 B1 12/2003 Crutcher et al.
6,690,288 B1 2/2004 Waddell
6,768,424 B1 7/2004 Morris
6,784,798 B2 8/2004 Morris
6,819,257 B2 11/2004 Swieboda
6,838,994 B2 1/2005 Gutta et al.
6,873,254 B2 3/2005 Andres
6,970,077 B2 11/2005 Johnson
7,034,703 B2 4/2006 Morris (Continued)

OTHER PUBLICATIONS

Ball et al, "The Effect of Alcohol upon Response to Fire Alarm Signals in Sleeping Young Adults", Proceedings of 3rd International Symposium on Human Behaviour in Fire, Sep. 2004, Belfast, Northern Ireland, London: Interscience Communications pp. 291-302.

(Continued)

*Primary Examiner*—Tai T Nguyen
(74) *Attorney, Agent, or Firm*—Gary J. Morris

(57) ABSTRACT

An ambient condition detector outputs an alarm comprising a tonal pattern comprising at least two distinctly different pitch tones in one embodiment of the invention. Another embodiment comprises a detector whereby a user can select a pitch tone to be output within a tonal pattern alarm when the detector senses an ambient condition. Options include verbal output to indicate the type of ambient condition sensed and/or the location of the detector sensing the ambient condition.

38 Claims, 7 Drawing Sheets

U.S. PATENT DOCUMENTS

| | | | |
|---|---|---|---|
| 7,068,176 | B2 | 6/2006 | Black et al. |
| 7,170,397 | B2 | 1/2007 | Roby et al. |
| 7,170,404 | B2 | 1/2007 | Albert et al. |
| 7,372,370 | B2 | 5/2008 | Stults et al. |
| 2002/0130782 | A1 | 9/2002 | Johnston et al. |
| 2006/0214809 | A1 | 9/2006 | Sistare |

OTHER PUBLICATIONS

Bruck et al, "Recognition of Fire Cues During Sleep", 2001, Proceedings of Second International Symposium on Human Behaviour in Fire, London Interscience Communications, pp. 241-252.

Ball et al, "The Salience of Fire Alarm Signals for Sleeping Individual: A Novel Approach to Signal Design", Sep. 2004, Proceedings of 3rd International Symposium on Human Behaviour in Fire, Belfast, Northern Ireland, London: Interscience Communications, pp. 303-314.

Bruck et al, "The Effective of Different Alarms in Waking Sleeping Children", Sep. 2004, Proceedings of 3rd International Symposium on Human Behaviour in Fire, Belfast, Northern Ireland, London: Interscience Communications, pp. 279-290.

Bruck et al, "Reducing Fire Deaths in Older Adults: Optimizing the Smoke Alarm Signal Research Project", The Fire Protection Research Foundation, May 2006.

Task Force to Study Visual Smoke and Evacuation Alarms for the Deaf and Hard of Hearing, State of Maryland Governor's Office of the Deaf and Hard of Hearing, Sep. 2006.

Loudenlow Smoke Alarm—The Darrow Company, Apr. 3, 2005 http://web.archive.org/web/20050403225154/http://loudenlow.com/.

* cited by examiner

AMBIENT CONDITION DETECTOR WITH VARIABLE PITCH ALARM

BACKGROUND

The pitch of tones within tonal patterns emitted by ambient condition detector units and systems in the alarm or testing state is not always optimum to be heard by a wide range of users. As one example, the elderly often suffer from a deficit of high frequency hearing sensitivity and may hear a lower pitch tonal pattern better than a higher pitch pattern. Other users may respond better to a higher pitch tonal pattern. As another example, various types of ambient noise may result in a tonal pattern containing preferred pitch tones that could most readily be heard in the event of a sensed ambient condition. Many conventional ambient condition detectors emit a tonal pattern with an average tone pitch on the order of 3 kHz in frequency.

BRIEF DESCRIPTIONS OF THE DRAWINGS

DETAILED DESCRIPTION

Figure 1:
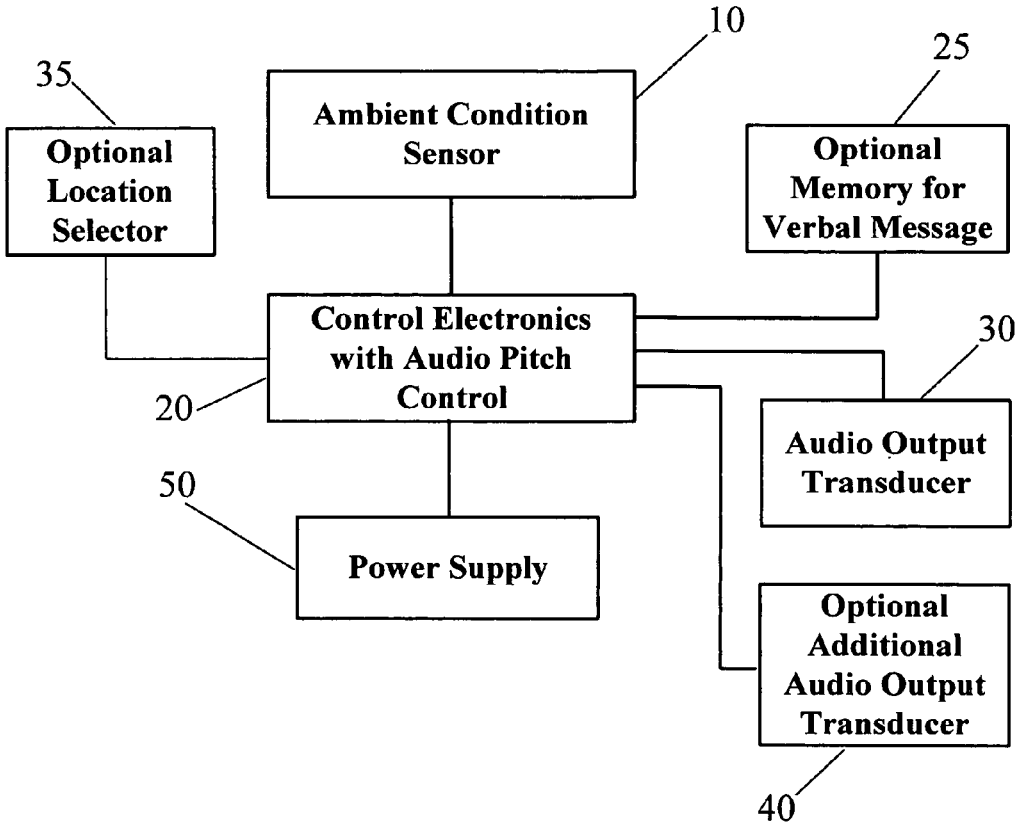
FIG. 1 is a block diagram of one embodiment of the invention using control electronics with audio pitch control capability to control the pitch of the tones emitted by the audio output transducer.

While the various embodiments of this invention can take many different forms, specific embodiments thereof are shown in the drawings and will be described in detail herein with the understanding that the present disclosure is to be considered as an exemplification of the principles of the invention and is not intended to limit the scope of the invention to any specific embodiments illustrated or described.

One of the embodiments is an ambient condition detector unit shown in FIG. 1 where an ambient condition sensor 10 is connected to control electronics with audio pitch control 20 such that sensing of an ambient condition by ambient condition sensor 10 provides an input signal to the control electronics with audio pitch control 20. The control electronics with audio pitch control 20 may be microprocessor based in one embodiment, and may be ASIC based in another embodiment and may contain electronic memory for one or more alarm tonal patterns comprising one or more pitch tones included within the tonal patterns and one or more silent periods within the tonal patterns. When the ambient condition sensor 10 senses an ambient condition, the control electronics with audio pitch control 20 sends an output signal to the audio output transducer 30 such that the audio output transducer 30 emits a tonal pattern comprising tones having pitch controlled by the control electronics with audio pitch control 20. The control electronics with audio pitch control 20 controls the tonal pattern and tonal pitch.

Figure 3:
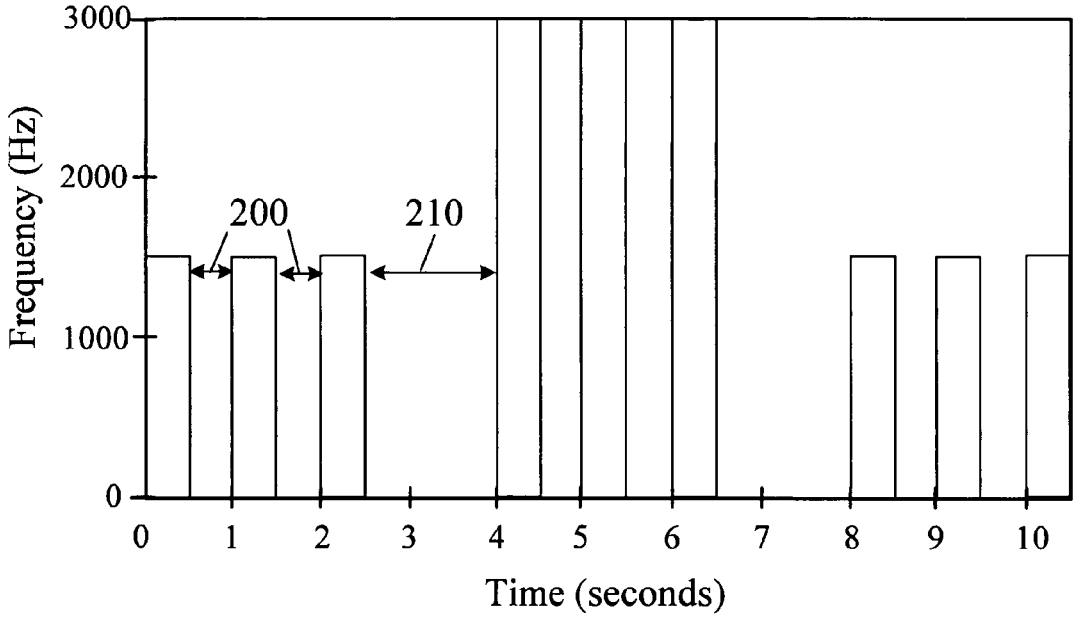
FIG. 3 is an example tonal pattern illustrating an inter-group alternating pitch sequence in one embodiment.
Figure 4:
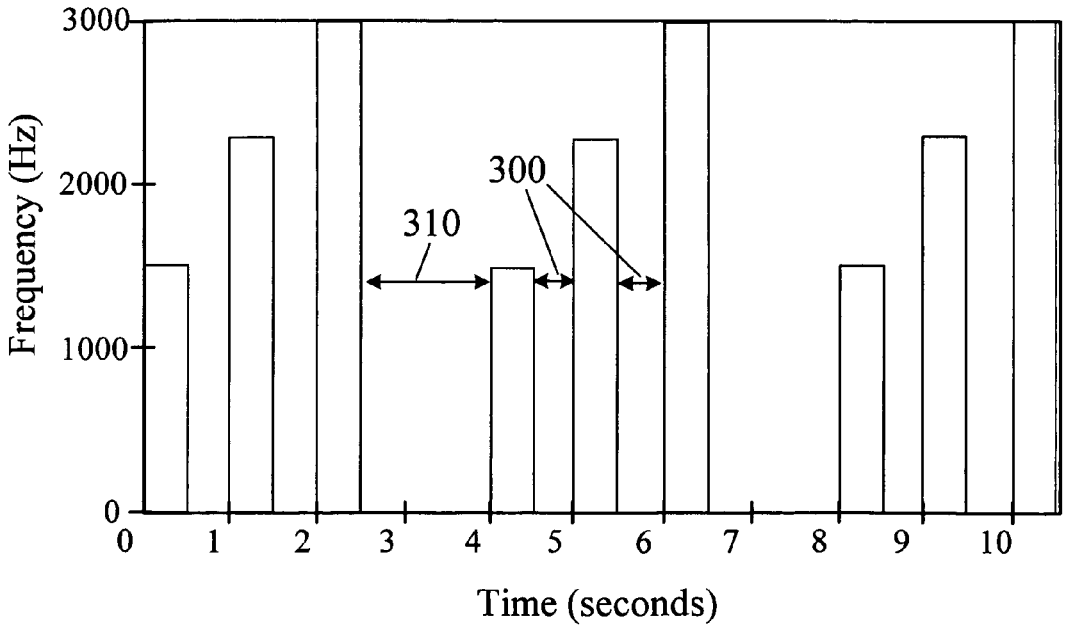
FIG. 4 is an example tonal pattern illustrating a ramped intra-group pitch sequence in one embodiment.
Figure 5:
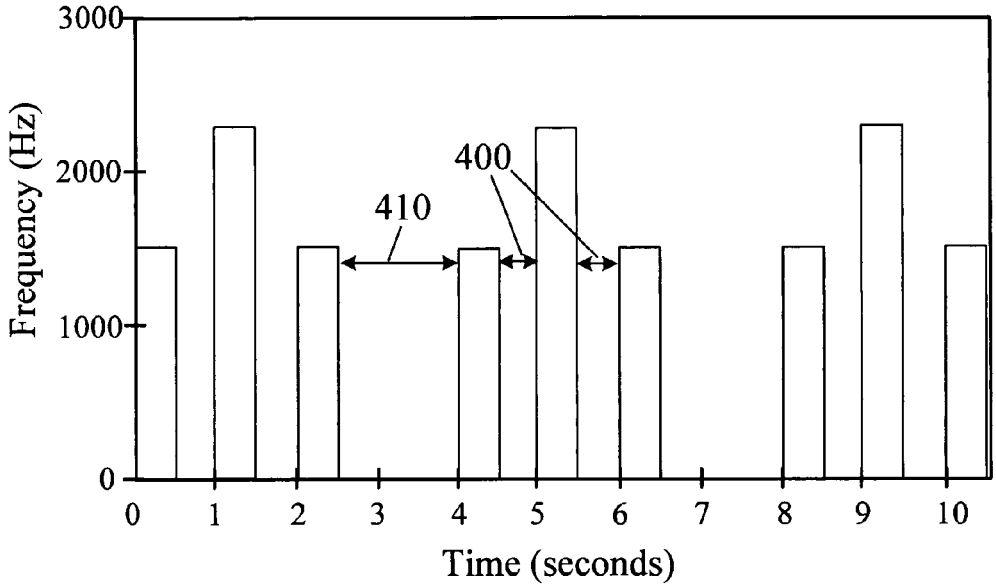
FIG. 5 is an example tonal pattern illustrating an alternating intra-group pitch sequence in one embodiment.

In at least one embodiment, a tone group comprises tones separated by at least one silent period. The silent period between repeating of the tone group is longer than the silent periods within the tone group. For example, in FIG. 3, FIG. 4, and FIG. 5 the first three tones illustrated comprise a first tone group and the second three tones illustrated in each figure comprise a second tone group separated from the first tone group by at least twice the time present between any two tones within a tone group. Times between tone groups are called inter-group temporal spacing 210, 310, and 410 and times between individual tones within a tone group are call intra-group temporal spacing 200, 300, and 400. It is noted that the illustrative example of three tones in a tone group as shown in FIG. 3, FIG. 4, and FIG. 5 are not intended to be limiting. More or less than three tones may comprise a tone group, in general, as is shown in an example in FIG. 6.

In one embodiment, the tonal pattern comprises tone groups with intra-group temporal spacing of a first amount and inter-group temporal spacing of a second amount wherein the second amount is at least twice as much as the first amount wherein the tones comprise at least two distinctly different pitches.

Distinctly different pitches means that a normal human ear can detect a difference between the pitches (often referred to a just noticeable difference). As one example, the just noticeable difference in pitch for the normal human ear is on the order of 0.5% of the tone frequency when that tone frequency is on the order of a few thousand hertz. Other values of just noticeable differences in pitch for the normal human ear are well known in the field of acoustics. It is noted that tone pitches may be composites of more than one tone frequency and still fall within the scope of the invention. As such, distinctly different pitches may also be composites of more than one tone frequency so long as a normal human ear can detect an audible difference between such pitches.

As little as one tone may be contained within a tone group in another embodiment, in which case the intra-group temporal spacing would go to zero and the inter-group temporal spacing would be the only spacing between tones.

Sample tonal patterns with varying pitch sequences of various embodiments are shown in FIG. 3, FIG. 4, FIG. 5, and FIG. 6.

Tonal patterns are comprised of at least one tone group and are differentiated by the number of tones and temporal spacings between the tones within the tone groups (intra-group temporal spacing) and the temporal spaces between repeated tone groups (inter-group temporal spacing). As an example, FIG. 3, FIG. 4, and FIG. 5 illustrate the same tonal pattern but contain different pitch tones or different pitch sequences. Silent periods or silent times of a tonal pattern refer to times when no tonal alarm is present; however, silent periods or times do not preclude the presence of a non-tonal emission such as a verbal output.

In at least one embodiment, the tonal pattern(s) and distinctly different pitch tones are factory set and are not user selectable.

In one embodiment, verbal output is used to describe the type of condition sensed or the location of the detector sensing the condition, or both, or instructions on how to remain safe in accordance with the sensed to condition. At least one word is used to describe the type of ambient condition or location of the ambient condition sensed. In this embodiment, the control electronics with audio pitch control 20 contains voice synthesis circuitry to electronically output a recorded verbal message held in memory 25 to the audio output transducer 30 or additional audio output transducer 40 when there are silent periods in the tonal pattern. The control electronics with audio pitch control 20 contains circuitry to determine which ambient sensor within the ambient condition detector sensed the condition in embodiments with a plurality of different ambient condition sensors and can thereby output the appropriate verbal message to indicate the type of condition sensed.

In another embodiment having verbal output, the optional location selector 35 is present and connected to the control electronics with audio pitch control 20 where the location selector 35 is used to select the location where the ambient condition detector is installed, said location information is stored within the control electronics with audio pitch control 20. In this embodiment, the optional memory for verbal messages 25 is present and includes memory space to store at least one verbal message indicative of the installation location of the ambient condition detector. Example location messages include but are not limited to "basement", "kitchen", "living room", "bedroom", utility room", "second floor", etc. When the ambient condition sensor 10 senses an ambient condition, the control electronics with audio pitch control 20 outputs a tonal pattern to the audio output transducer 30, whereby during at least one silent period occurring within the tonal pattern, at least one word of a verbal message is output to indicate the location of the ambient condition detector sensing the ambient condition. The optional location selector 35 is accessible to the user and may take the form, without limitation, of a DIP switch, a jumper(s), a rotary switch, an electrical contact, or momentary switch in various embodiments. Only embodiments which emit verbal output include optional memory for verbal message 25.

In at least one embodiment, an optional additional audio output transducer(s) 40 may be included to most effectively emit specific pitches of the alarm tones. This may be particularly useful, but not required, where piezoelectric elements are used for the audio output devices or in embodiments where verbal output is used. The audio output device 30 is a speaker in at least one embodiment.

In one embodiment, two different ambient condition sensors are included within the same unit to sense two different ambient conditions wherein the tonal patterns for each sensed condition are different and the pitches of the tones, within the respective tonal patterns, may be the same or distinctly different. In one such embodiment, one ambient condition sensor is a smoke or fire sensor and the other sensor is a gas sensor such as carbon monoxide or natural gas.

The power supply 50 is a battery power supply in one embodiment, an AC power supply in another embodiment, an AC power supply with battery back-up in another embodiment, and a hardwired DC power supply in another embodiment. The power supply 50 provides electrical power to the electrical components of the ambient condition detector unit.

Figure 2:
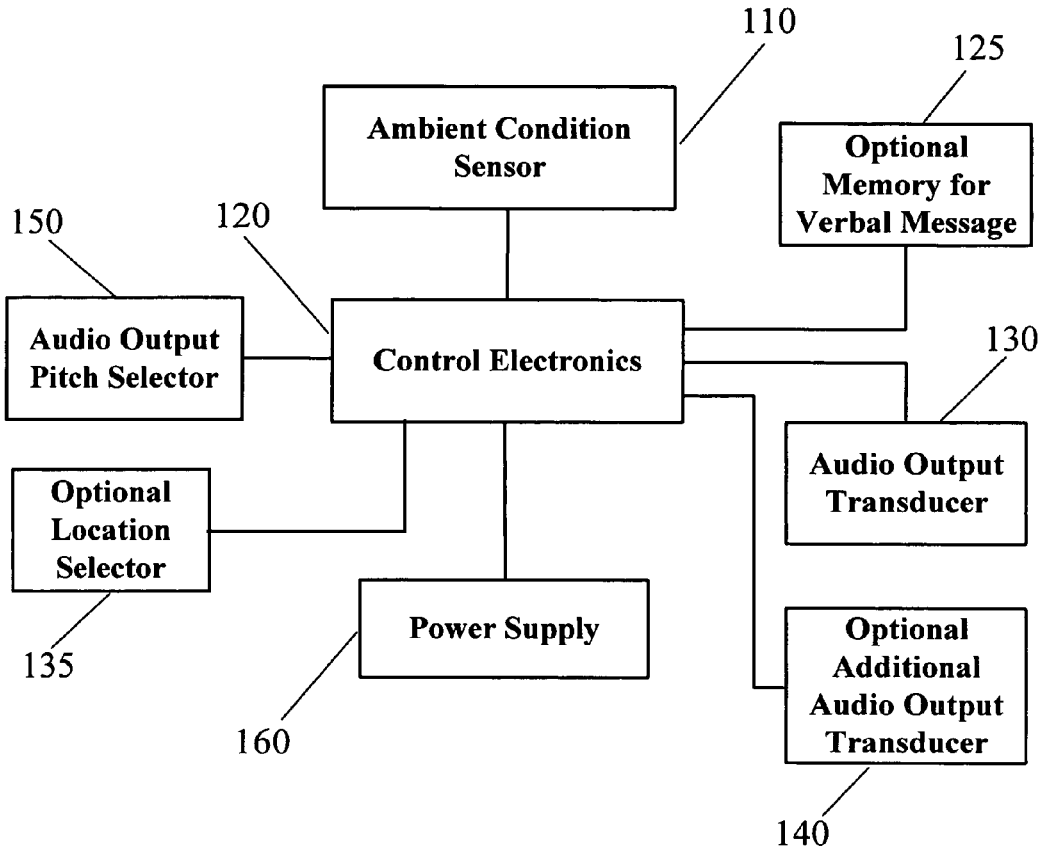
FIG. 2 is a block diagram of one embodiment of the invention using an audio output pitch selector to control the pitch of the tones emitted by the audio output transducer.

Another embodiment is an ambient condition detector unit shown in FIG. 2 where an ambient condition sensor 110 is connected to control electronics 120 such that sensing of an ambient condition by ambient condition sensor 110 provides an input signal to the control electronics 120. The control electronics 120 is microprocessor based in one embodiment and may be ASIC based in another embodiment and may contain electronic memory for one or more alarm tonal patterns containing one or more tone pitches included within tone groups or between successive tone groups and one or more silent periods within the tonal patterns. The control electronics 120 may further include electronic storage to store an identifier, such as an electronic memory pointer, to indicate which tonal output is selected by the user through the audio output pitch selector 150. Alternatively, in another embodiment, the configuration or position of the audio output pitch selector 150 is read by the control electronics 120 to determine the user's selection of the desired tonal output. The control electronics 120 sends an output signal to the audio output transducer 130 such that the audio output transducer 130 emits a tonal pattern having at least one pitch controlled by the control electronics 120 as electronically directed by the input of the audio output pitch selector 150. The control electronics 120 controls the tonal pattern and tone pitch in one embodiment. Alternatively, the audio output transducer 130 has included circuitry to control the pitch of the tonal output, but selection of pitch is controlled by the control electronics 120 as electronically directed by the input of the audio output pitch selector 150.

A user may interface with the audio output pitch selector 150 in various ways in various embodiments. The audio output pitch selector 150 is a multi-position switch in one embodiment, a DIP switch in another embodiment, a variable resistor in another embodiment, a momentary switch in another embodiment, a jumper in another embodiment, and a receiver of radiant energy, such as but not limited to an infrared light receiver or radio frequency, in another embodiment. The audio output selector 150 is connected to the control electronics 120. In an embodiment where the audio output pitch selector 150 comprises an infrared energy receiver or radio frequency signal receiver, the electronics contained therein decodes the incoming signal to interface to the control electronics 120 to select the tone pitch desired.

Figure 7:
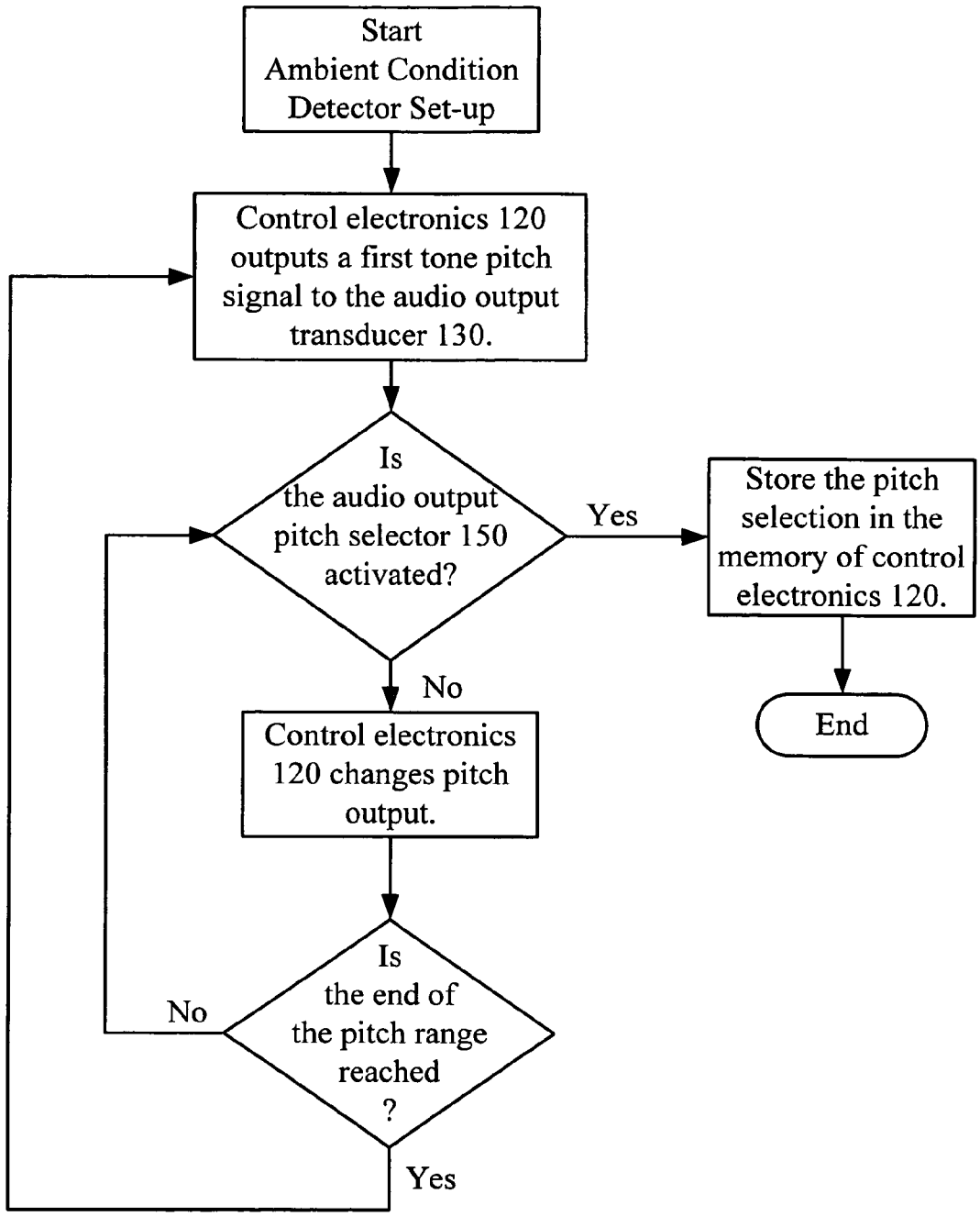
FIG. 7 is a flow chart of an electronic instruction set to permit the user to select a pitch of at least one tone to be output when an ambient condition is detected.

In one embodiment, user interfacing with the audio output pitch selector 150 permits the user to select at least one pitch of a tone within the emitted tonal pattern from the audio output transducer 130 by activating the audio output pitch selector 150 when the desired pitch is heard by the user during setup of the ambient condition detector (often as part of installation of the detector) as the control electronics 120 drives the audio transducer 130 to play through a menu of pre-programmed pitches and/or tonal patterns of varying pitch from which the user may select. The menu is stored within the control electronics 120. The tonal patterns may include silent periods. At least one software or firmware program or similar electronic instruction is stored within the control electronics 120 to output a range of tone pitches to the audio output transducer 130 and to identify the user-selected pitch when selected by the user during ambient condition detector setup and/or installation as shown in FIG. 7 as a non-limiting example. In one embodiment, during set-up of the ambient condition detector, the control electronics plays through the menu of pre-programmed tonal patterns which comprise at least two distinctly different pitch tones. When the user hears the tonal pattern with the desired pitch content, the user activates the audio output pitch selector 150 to store that selection identifier (electronic memory location pointer in one embodiment) into the memory of the control electronics 120.

Figure 9:
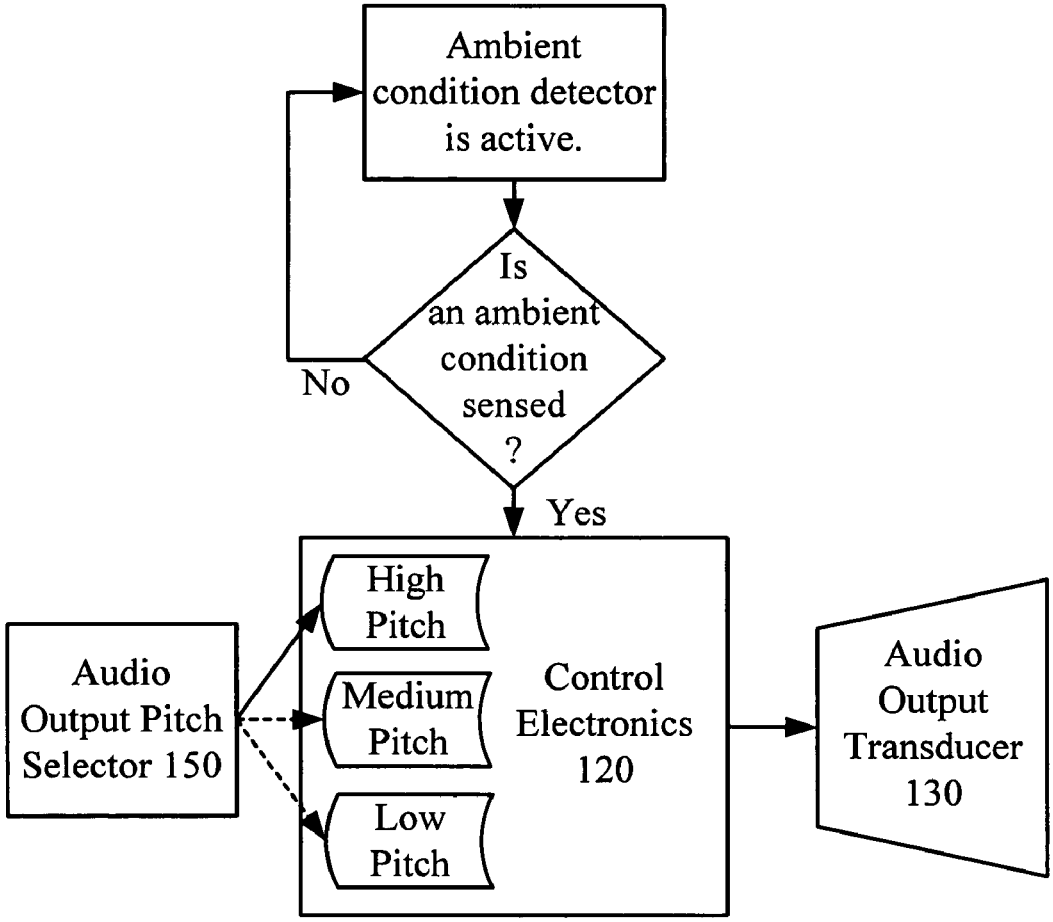
FIG. 9 illustrates one example of the flow diagram for a user-selected tone pitch for one embodiment with low, medium, and high pitches (high pitch selection indicated by the solid arrow in this example).

In another embodiment, the audio output pitch selector 150 is used to permit the user to make a selection from a choice of two or more distinctly different pitch tone groups, each tone group comprised of equal pitch tones, within tonal patterns factory-stored within the control electronics 120. The tone group choices may include silent periods. As a non-limiting example in one embodiment, the user may employ the audio output pitch selector 150 to choose from low, medium, and high pitch selections for the output tonal pattern where low, medium, and high may refer to pitch frequencies on the order of 1000 Hz, 2000 Hz, and 3000 Hz, respectively, as just one example. FIG. 9 illustrates one example of the flow diagram for a user selected pitch for one embodiment with low, medium, and high pitches. This diagram may apply to more or less than three pitch selections. In this embodiment, the audio output pitch selector 150 instructs the control electronics 120 which factory-stored, tonal pitch sequence to send to the audio output transducer 130 when an ambient condition is detected.

Figure 8:
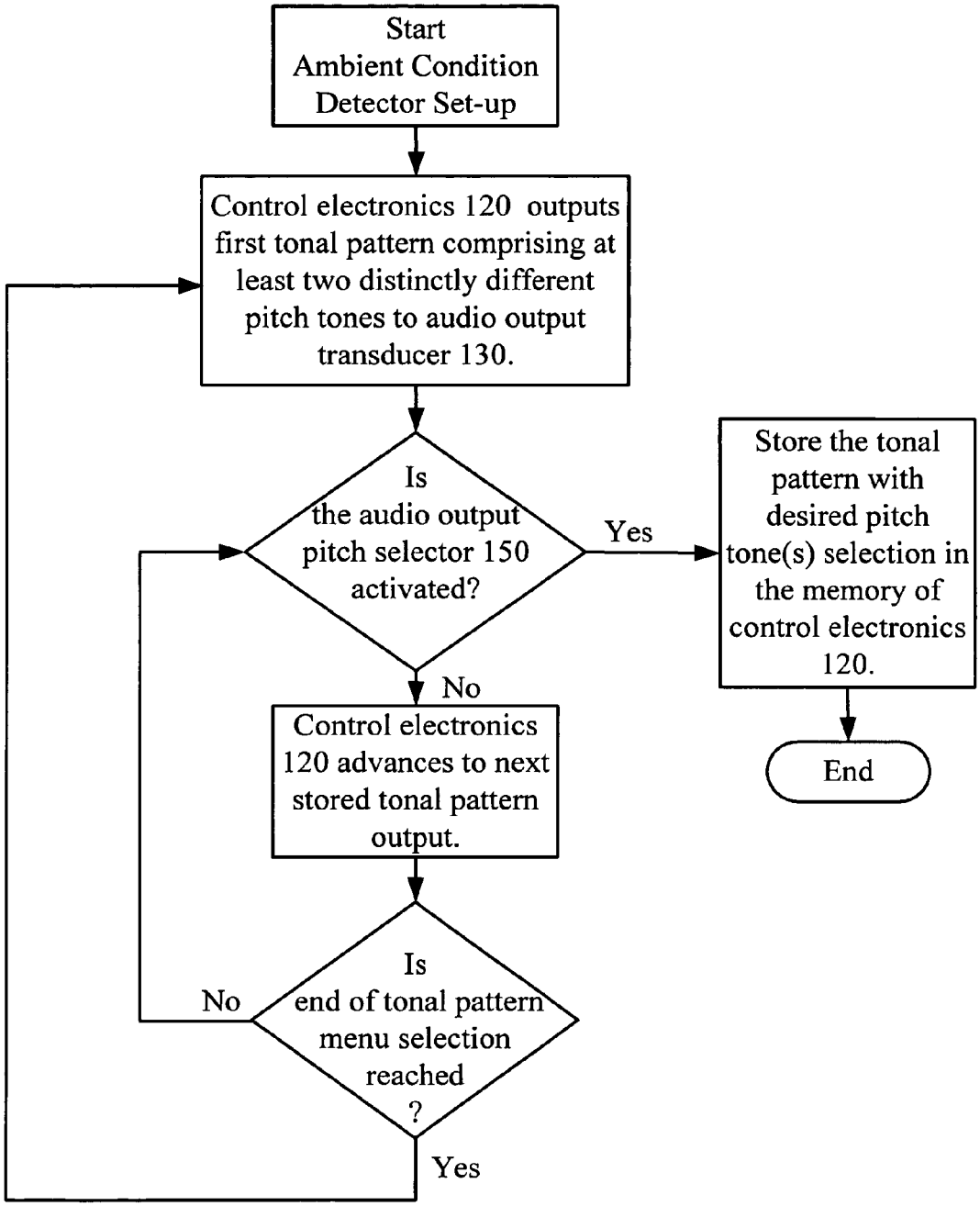
FIG. 8 is a flow chart of an electronic instruction set to permit the user to select a tonal pattern comprising at least two distinctly different pitch tones when an ambient condition is detected.

In another embodiment, user interfacing with the audio output pitch selector 150 permits the user to select from two or more alarm tones each comprising at least two distinctly different tonal pitches emitted from the audio output transducer 130. At least one software or firmware program or similar electronic instruction to yield the at least two distinctly different tonal pitches within tone groups or between tone groups is stored electronically within the control electronics 120 in one embodiment. One flow chart illustration of an electronic instruction is shown in FIG. 8 as a non-limiting example. In at least one embodiment, a tone group comprises tones separated by at least one silent period. The time between repeating of the tone group is longer than the silent periods within the tone group. For example, in FIG. 3, FIG. 4, and FIG. 5 the first three tones illustrated in each figure comprise a first tone group and the second three tones illustrated comprise a second tone group separated from the first tone group by at least twice the time present between any two tones within a tone group. Times between tone groups are called inter-group temporal spacing 210, 310, and 410 and times between individual tones within a tone group are call intra-group temporal spacing 200, 300, and 400. It is noted that the illustrative example of three tones in a tone group as shown in FIG. 3 is not intended to be limiting. More or less than three tones may comprise a tone group, in general as is shown in an example in FIG. 6.

As little as one tone may be contained within a tone group in one embodiment, in which case the intra-group temporal spacing would go to zero and the inter-group temporal spacing would be the only spacing between tones.

In at least one embodiment, the tonal pattern comprises tone groups with intra-group temporal spacing of a first amount and inter-group temporal spacing of a second amount wherein the second amount is at least twice as much as the first amount. Sample tonal patterns with varying pitch sequences of various embodiments are shown in FIG. 3, FIG. 4, FIG. 5, and FIG. 6.

Tonal patterns are comprised of at least one tone group and are differentiated by the number of tones and temporal spacings between the tones within the tone groups (intra-group temporal spacing) and the temporal spaces between repeated tone groups (inter-group temporal spacing). As an example, FIG. 3, FIG. 4, and FIG. 5 illustrate the same tonal pattern but contain different pitch tones or different pitch sequences. Silent periods or silent times of a tonal pattern refer to times when no tonal alarm is present; however, silent periods or times do not preclude the presence of a non-tonal emission such as a verbal output.

In one embodiment, verbal output is used describe the type of condition sensed or the location of the detector sensing the condition, or both, or instructions on how to remain safe in accordance with the sensed to condition. At least one word is used to describe the type of ambient condition or location of the ambient condition sensed. In this embodiment, the control electronics 120 contains voice synthesis circuitry to electronically output a recorded verbal message held in memory 125 to the audio output transducer 130 or additional audio output transducer 140. Only embodiments which emit verbal output include optional memory for verbal message 125. The control electronics 120 contains circuitry to determine which ambient sensor within the ambient condition detector sensed the condition in embodiments with a plurality of different ambient condition sensors and can thereby output the appropriate verbal message to indicate the type of condition sensed.

In another embodiment having verbal output, the optional location selector 135 is present and connected to the control electronics 120 where the optional location selector 135 is used to select the location where the ambient condition detector is installed, said location information is stored within the control electronics 120. In this embodiment, the optional memory for verbal messages 125 is present and includes memory space to store at least one verbal message indicative of the installation location of the ambient condition detector. Example location messages include but are not limited to "basement", "kitchen", "living room", "bedroom", utility room", "second floor", etc. When the ambient condition sensor 110 senses an ambient condition, the control electronics 120 outputs a tonal pattern to the audio output transducer 130, whereby during at least one silent period occurring within the tonal pattern, at least one word of a verbal message is output to indicate the location of the ambient condition detector sensing the ambient condition. The optional location selector 135 is accessible to the user and may take the form, without limitation, of a DIP switch, a jumper, a multi-position switch, an electrical contact, or momentary switch in various embodiments. Only embodiments which emit verbal output include optional memory for verbal message 125.

In at least one embodiment, an additional audio output transducer(s) 140 may be included to most effectively emit specific pitches of the alarm tones. This may be particularly useful, but not required, where piezoelectric elements are used for the audio output devices or in embodiments where verbal output is used. An audio output device 130 is a speaker in at least one embodiment.

The power supply 160 is a battery power supply in one embodiment, an AC power supply in another embodiment, an AC power supply with battery back-up in another embodiment, and a hardwired DC power supply in another embodiment. The power supply 160 provides electrical power to the electrical components of the ambient condition detector unit.

Figure 6:
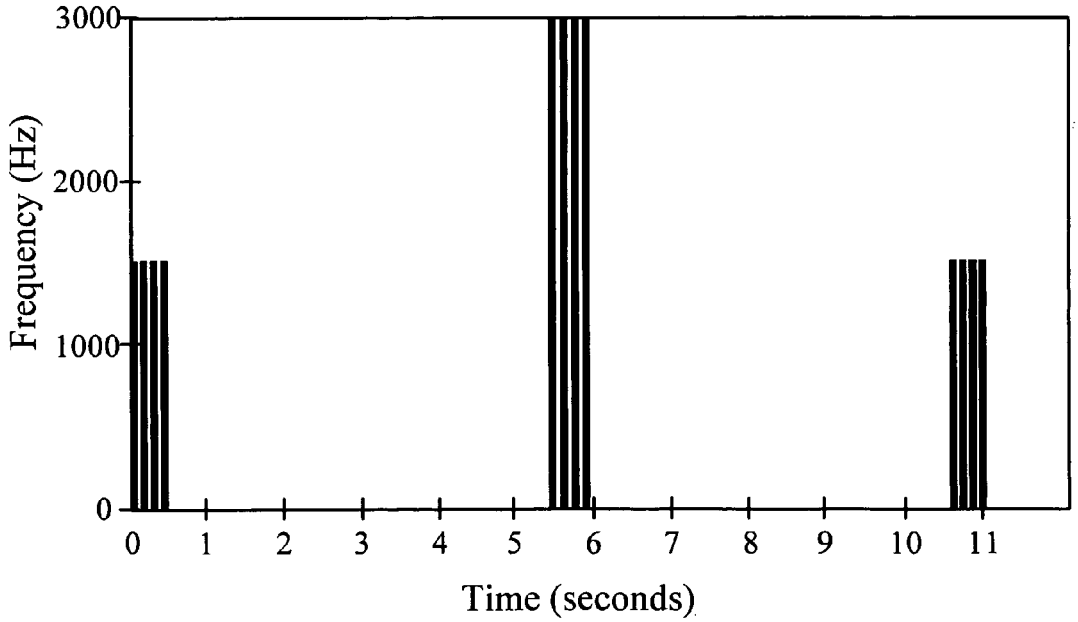
FIG. 6 is an example tonal pattern illustrating an inter-group alternating pitch sequence typically used in one gas detector embodiment.

Various sample pitch sequences of tonal patterns are illustrated in FIG. 3, FIG. 4, FIG. 5, and FIG. 6 for various embodiments and are in no way intended to be limiting but serve as exemplary tonal patterns having at least two distinctly different pitch tones which may output by the ambient condition detector. While the sample, triple tonal groupings (FIGS. 3-5) are most relevant to smoke or fire detector embodiments of the ambient condition detector, similar variable pitch tonal patterns may be output for other ambient condition detectors such as gas detectors which may output a quadruple tonal grouping within one embodiment (FIG. 6).

FIG. 3 illustrates an inter-group alternating pitch sequence for a tonal pattern of one embodiment where the inter-group temporal spacing 210 is at least twice the amount of the intra-group temporal spacing 200.

FIG. 4 illustrates an inter-group ramping pitch sequence for a tonal pattern of one embodiment where the inter-group temporal spacing 310 is at least twice the amount of the intra-group temporal spacing 300.

FIG. 5 illustrates an intra-group alternating pitch sequence for a tonal pattern of one embodiment where the inter-group temporal spacing 410 is at least twice the amount of the intra-group temporal spacing 400.

FIG. 6 is an example tonal pattern illustrating an inter-group alternating pitch sequence used in one gas detector embodiment. Other pitch variance sequences similar but not limited to those shown in FIG. 3, FIG. 4 and FIG. 5 (inter-group alternating, intra-group ramping and intra-group alternating, respectively) may be used for gas detectors in other embodiments. Still other tonal patterns and pitch sequences may be used for other ambient conditions.

In at least one embodiment, a housing is used to enclose components such as, but not limited to, the control electronics, the ambient condition sensor, and the audio output transducer. The housing permits the ambient condition sensor to sense at least one ambient condition originating outside of the housing through openings or optical sensors viewing through the housing wall as well as with sensors within the housing such as, but not limited to, smoke sensors, fire sensors, thermal sensors, gas sensors, vibration sensors, motion sensors, and radiation sensors.

The various embodiments described above are merely descriptive and are in no way intended to limit the scope of the invention. Modification will become obvious to those skilled in the art in light of the detailed description above, and such modifications are intended to fall within the scope of the appended claims. It is to be understood that no limitation with respect to the specific apparatus illustrated herein is intended or should be inferred.

I claim:

1. An ambient condition detector to detect at least one ambient condition comprising:

control electronics with audio pitch control;

at least one ambient condition sensor to sense an ambient condition coupled to the control electronics with audio pitch control;

at least one audio output transducer coupled to the control electronics with audio pitch control;

the control electronics with audio pitch control outputs an alarm tonal pattern through the at least one audio output transducer when the at least one ambient condition sensor detects an ambient condition, the tonal pattern comprising at least two distinctly different tone pitches with at least one silent period within the tonal pattern occurring between the distinctly different tone pitches;

the at least two distinctly different tone pitches differ by at least a frequency of 500 Hz so a tonal pattern emitted by the at least one audio output transducer may be heard by a wide range of users including users with a hearing sensitivity deficit;

and the at least one ambient condition sensor comprises at least one of a smoke sensor, a fire sensor, thermal sensor, a gas sensor, a motion sensor, or a radiation sensor.

2. The ambient condition detector in claim 1 wherein the tonal pattern comprises tone groups with intra-group temporal spacing of a first amount and inter-group temporal spacing of a second amount wherein the second amount is at least twice the first amount.

3. The tonal pattern of claim 2 wherein the tone groups comprise two distinctly different pitches.

4. The two distinctly different pitches of claim 3 wherein the pitches differ by at least a frequency of 1000 Hz.

5. The tonal pattern of claim 2 where the tone groups comprise three distinctly different pitches.

6. The tonal pattern of claim 2 wherein at least two tone groups are used, wherein the tones within one group are of distinctly different pitch than the tones within another group.

7. The tone groups of claim 2 further comprise at least one occurrence where one tone group includes constant pitch tones of a first pitch followed by a tone group including constant pitch tones of a second pitch where the first and second pitches are distinctly different.

8. The tone groups of claim 7 wherein the pitch tones are factory pre-set and user non-selectable.

9. The ambient condition detector of claim 1 further comprising at least one additional audio output transducer.

10. The tonal pattern of claim 1 wherein the at least two distinctly different tone pitches are factory set and are user non-selectable.

11. The at least two distinctly different tone pitches of claim 1 wherein one of the tone pitches is on the order of 3000 Hz and an another of the tone pitches is less than or equal to 2500 Hz.

12. The at least two distinctly different tone pitches of claim 1 wherein one of the tone pitches is less than or equal to 1500 Hz.

13. The ambient condition detector of claim 1 wherein the tonal pattern comprises an alternating inter-group pitch sequence.

14. The ambient condition detector of claim 1 wherein the tonal pattern comprises an alternating intra-group pitch sequence.

15. The ambient condition detector of claim 1 wherein the tonal pattern comprises a ramped intra-group pitch sequence.

16. An ambient condition detector to detect at least one ambient condition and to provide an audible tonal alarm pattern which facilitates hearing of the alarm pattern by users having a hearing deficit comprising:

control electronics;

an ambient condition sensor, which senses the presence of an ambient condition, coupled to the control electronics such that when the ambient condition sensor senses the presence of an ambient condition, the control electronics sends an output signal to an audio output transducer coupled to the control electronics;

the audio output transducer emits an audible alarm tonal pattern controlled by the control electronics;

the audible alarm tonal pattern comprises a plurality of distinctly different tone pitches, whereby at least one tone pitch is separated temporally from a distinctly different tone pitch by at least one silent period where no audible tone pitch is emitted by the audio output transducer;

the at least one tone pitch differs in frequency by at least 1000 Hz with respect to the distinctly different tone pitch so an audible alarm tonal pattern emitted by the audio output transducer may be heard by a wide range of users;

the audible alarm tonal pattern further comprises tone groups with intra-group temporal spacing of a first amount and inter-group temporal spacing of a second amount wherein the inter-group temporal spacing of the second amount is at least twice the intra-group temporal spacing of the first amount;

the ambient condition sensor comprises at least one of a smoke sensor, a fire sensor, a thermal sensor, a gas sensor, a motion sensor or a radiation sensor;

a power supply for the control electronics comprising at least one of an alternating current power supply, a hard-wired direct current power supply, and a battery power supply; and a housing encloses at least the control electronics, the ambient condition sensor and the audio output transducer.

17. The ambient condition detector in claim 16 wherein the plurality of distinctly different tone pitches is factory set and is user non-selectable.

18. The tonal pattern of claim 16 wherein tones within the tone groups comprise at least two distinctly different tone pitches.

19. The tonal pattern of claim 16 wherein at least two tone groups are used, wherein at least one tone within one tone group is a distinctly different pitch than at least one tone within another tone group.

20. The at least one tone within one tone group in claim 19 comprises a low pitch to enhance hearing of the at least one tone by a person with a deficit in high frequency hearing sensitivity and the at least one tone within another tone group comprises a higher pitch of at least 1500 Hz.

21. The at least one tone within one tone group in claim 19 comprises a composite of more than one tone frequency.

22. The tone groups of claim 16 further comprise at least one occurrence where one tone group includes constant tone pitches of a first pitch and another tone group includes constant tone pitches of a second pitch where the first and second pitches are distinctly different.

23. The tone groups of claim 22 wherein the first pitch is at least 1500 Hz, and second pitch is a lower frequency to enhance hearing of the second pitch by a user with a deficit in high frequency hearing sensitivity.

24. The ambient condition detector of claim 16 wherein at least one tone pitch is on the order of 3000 Hz.

25. The ambient condition detector of claim 16 wherein at least one tone pitch is on the order of 1500 Hz or less.

26. An ambient condition detector to detect the presence of at least one ambient condition comprising:

an ambient condition sensor to sense the presence of an ambient condition;

an electronic circuit to control a plurality of audible alarm tonal patterns emitted by an audio output transducer at least when the ambient condition sensor senses the presence of the ambient condition;

at least one of the audible alarm tonal patterns comprises at least two distinctly different pitch tones;

the distinctly different pitch tones are separated by at least one time interval where no audible pitch tones are emitted by the audio transducer;

one of the distinctly different pitch tones within the at least one of the audible alarm tonal patterns is at least 1000 Hz lower in frequency than another pitch tone within the at least one of the audible alarm tonal patterns; and the at least one ambient condition sensor comprises at least one of a smoke sensor, a fire sensor, thermal sensor, a gas sensor, a motion sensor, or a radiation sensor.

27. The ambient condition detector in claim 26 wherein the distinctly different pitch tones are factory set and are user non-selectable.

28. The ambient condition detector of claim 26 wherein the electronic circuit controls audible tonal patterns emitted by a second audio output transducer.

29. The ambient condition detector of claim 26 wherein one of the distinctly different pitch tones within the at least one of the audible alarm tonal patterns is on the order of 3000 Hz and another pitch tone within the at least one of the audible alarm tonal patterns is on the order of 1500 Hz or lower frequency so that a tonal pattern emitted by the ambient condition detector may be heard by a wide range of users.

30. The at least two distinctly different pitch tones of claim 26 wherein one of the pitch tones is on the order of 3000 Hz and an another of the pitch tones is less than or equal to 2000 Hz.

31. The ambient condition detector of claim 26 wherein the at least one tonal pattern further comprises a first tone group comprising constant pitch tones and a second tone group comprising constant pitch tones wherein the constant pitch tones within the first tone group are distinctly different than the constant pitch tones within the second group.

32. The ambient condition detector of claim 26 wherein the at least one of the alarm tonal patterns comprises an alternating inter-group pitch sequence.

33. An ambient condition detector to detect the presence of at least one ambient condition comprising:

an ambient condition sensor, to sense the presence of an ambient condition, the sensor electronically coupled to an electronic control circuit;

an audio output transducer electronically coupled to the electronic control circuit;

the electronic control circuit outputs a tonal pattern comprising a first audible tone group and a second audible tone group trough the audio output transducer while the ambient condition sensor senses the presence of the ambient condition, the first audible tone group comprises a first pitch tones and the second tone group comprises a second pitch tones;

the first pitch tones and the second pitch tones are distinctly different pitch tones;

the tonal pattern further comprises an inter-group temporal spacing between outputting of the first audible tone group and outputting the second audible tone group whereby during the inter-group temporal spacing, no audible tone is output by the audio output transducer, the second audible tone group is followed by another inter-group temporal spacing before outputting the first audible tone group again thereby producing a tonal pattern of alternating first and second audible tone groups, each tone group separated by inter-group temporal spacings; and the ambient condition sensor comprises sensor comprises at least one of a smoke sensor, a fire sensor, a thermal sensor, a gas sensor, a motion sensor, or a radiation sensor.

34. The ambient condition detector of claim 33 wherein the at least first pitch tone is greater than or equal to a fundamental frequency of 1500 Hz and the at least second pitch tone is at less than a fundamental frequency of 1500 Hz.

35. The ambient condition detector of claim 33 wherein the at least first pitch tone is less than a fundamental frequency of 1500 Hz and the at least second pitch tone is at least a fundamental frequency of 1500 Hz.

36. The distinctly different first and second pitch tones of claim 33 wherein at least one pitch tone is low frequency to enhance hearing of the at least one tone pitch by a user with a deficit in high frequency hearing sensitivity.

37. The ambient condition detector of claim 33 wherein the first tone pitch and the second tone pitch differ by at least 1000 Hz so a wide variety of users may hear a tonal pattern emitted by the ambient condition detector when an ambient condition is sensed.

38. An ambient condition detector to detect the presence of at least one condition comprising:

an ambient condition sensor to sense the presence of an ambient condition;

an electronic circuit to output a signal to drive a first audible tone group and a second audible tone group when the ambient condition sensor senses the presence of the ambient condition, the first audible tone group including at least a first pitch tone emitted by a first audio output transducer and the second tone group including at least a second pitch tone emitted by a second audio transducer;

the at least first pitch tone and the at least second pitch tone differ by at least a frequency of 1000 Hz;

a time interval between emission of the first audible tone group and emission of the second audible tone group whereby during the time interval, no audible tone is emitted by either the first or second audio output transducer;

the ambient condition sensor comprises at least one of a smoke sensor, a fire sensor, a thermal sensor, a gas sensor, a motion sensor, or a radiation sensor; and a housing encloses at least the electronic circuit, the ambient condition sensor, and the first and second audio output transducers.

* * * * *